US005860190A

United States Patent [19]

Cano

[11] Patent Number: 5,860,190

[45] Date of Patent: Jan. 19, 1999

[54] EXPANDED IMPLEMENT HANDLE GRIP

[76] Inventor: Rolando M. Cano, 604 Solar Dr., Mission, Tex. 78572-2359

[21] Appl. No.: 822,692

[22] Filed: Mar. 21, 1997

[51] Int. Cl.[6] ..... A47B 95/02

[52] U.S. Cl. ..... 16/114 R; 16/DIG. 12; 30/322; 30/327

[58] Field of Search ..... 16/110 R, 111 R, 16/115, 114 R, DIG. 12, DIG. 19; 294/171; 15/144.1, 144.2, 144.3, 143.1, 145; 30/291, 294, 295, 322, 325, 326, 327, 340; D7/653

[56] References Cited

U.S. PATENT DOCUMENTS

| | | | |
|---|---|---|---|
| 904,122 | 11/1908 | Fletcher . | |
| 2,319,147 | 5/1943 | Mason | 14/144 |
| 2,394,050 | 2/1946 | Goza | 294/171 |
| 2,519,186 | 8/1950 | Herbert et al. | 294/171 |
| 2,576,388 | 11/1951 | Claflin | 16/111 R |
| 2,701,379 | 2/1955 | Balistreri | 16/116 R |
| 2,751,683 | 6/1956 | Johns | 30/324 |
| 2,762,120 | 9/1956 | Mack | 30/1 |
| 2,889,624 | 6/1959 | McDonald | 30/324 |
| 3,037,783 | 6/1962 | Schlidt et al. | 16/114 R |
| 3,072,955 | 1/1963 | Mitchell | 16/114 |
| 3,227,445 | 1/1966 | Hulsman | 16/DIG. 12 |
| 3,682,023 | 8/1972 | Greene | 81/119 |
| 3,981,043 | 9/1976 | Curry | 16/110 R |
| 4,035,865 | 7/1977 | McRae et al. | 16/114 R |
| 4,259,761 | 4/1981 | Earle | 15/143 R |
| 4,283,808 | 8/1981 | Beebe | 15/145 |
| 4,389,777 | 6/1983 | Landsberger | 30/324 |
| 4,719,063 | 1/1988 | White | 264/45.2 |
| 4,811,637 | 3/1989 | McCleary | 81/177.2 |
| 4,890,355 | 1/1990 | Schulten | 16/111 R |
| 4,934,024 | 6/1990 | Sexton | 16/111 R |
| 4,956,917 | 9/1990 | Chung | 30/326 |
| 5,058,279 | 10/1991 | Mars | 30/327 |
| 5,060,386 | 10/1991 | Mars | 30/327 |
| 5,068,967 | 12/1991 | Mars | 30/324 |
| 5,075,975 | 12/1991 | Wilson | 30/322 |
| 5,251,380 | 10/1993 | Craig | 30/329 |
| 5,264,267 | 11/1993 | Wang | 428/76 |
| 5,348,360 | 9/1994 | Mencarelli et al. | 16/116 R |
| 5,373,643 | 12/1994 | Warren | 30/322 |

FOREIGN PATENT DOCUMENTS

| | | | |
|---|---|---|---|
| 3641340 | 6/1988 | Germany | 294/171 |

OTHER PUBLICATIONS

Smith & Nephew Rehabilitation Catalog, 1996, pp. 23A–24A, and 26A–29A.

*Primary Examiner*—Chuck Mah
*Attorney, Agent, or Firm*—David L. Mossman

[57] ABSTRACT

An expanded implement handle grip for placing over an implement handle of a spoon, fork, knife, toothbrush, hand tool, or the like has been devised which has improved concave features within the hollow, interior space thereof. These concave features, which include, but are not limited to dimples, grooves, spiral grooves, indentations, impressions, channels, depressions, hollows, slits, and the like, to permit the implement handle to be easily inserted into the grip, but nevertheless more effectively held by the expanded implement handle grip while being employed by a user with limited dexterity or strength. Other optional features such as sinuous slits, enlarged ends, and roll-inhibiting features allow the expanded implement handle grip to have improved function.

21 Claims, 4 Drawing Sheets

EXPANDED IMPLEMENT HANDLE GRIP

FIELD OF THE INVENTION

The invention relates to grips and devices to augment an implement handle, such as the handle of an utensil or hand tool, and further relates, in one embodiment, to grips and devices that enhance the ability of a person with limited dexterity or strength to grasp an implement.

BACKGROUND OF THE INVENTION

Devices for enhancing the ability of a person to hold and grip an object, tool, or implement are well known in the art. Such devices are typically used by people who have limited dexterity or strength, such as a person with arthritis or someone who has suffered injury to the hands, or someone born with a physical disability. These augmented handles are also used by children, particularly as they learn to use table utensils, and also by people to facilitate the holding of many kinds of objects, particularly objects which are tiresome to hold for periods of time.

For example, U.S. Pat. No. 3,072,955 discloses hand grips for use with shopping bags, parcels tied with strings or wire and the like, the bails of buckets, baskets and other containers, handles on cooking implements, such as pots and pans, and numerous hand tools, such as screw drivers and the like.

A turnbuckle wrench comprising an elongated slotted body is described in U.S. Pat. No. 3,682,023. The link of the turnbuckle is fitted within the slot and the wrench rotated to tighten or loosen the turnbuckle. Retaining elements hold the wrench onto the turnbuckle.

U.S. Pat. No. 4,035,865 discloses that implements of the hand-manipulated type may be equipped with spherical handles that can be easily grasped by persons afflicted with arthritis. The spherical handle has a diameter that permits the sphere to be retained against the person's palm between the thumb and a finger without bending internal joints.

Despite the plurality of patented and unpatented devices on the market, there remains a need for an expanded implement handle grip which can be used on a plurality of different kinds of utensils, tools, and devices, which permits the user to firmly grasp the handle, and which is comfortable and easy to hold.

It would be desirable and advantageous if a new expanded implement handle grip could be devised and discovered which would overcome the disadvantages of some of the prior art devices, and which could be readily and inexpensively manufactured.

SUMMARY OF THE INVENTION

Accordingly, it is an object of the present invention to provide an expanded implement handle grip which can be employed with a variety of different kinds of tool, utensil, and implement handles.

It is another object of the present invention to provide an expanded implement handle grip which has improved grasping or frictional holding between the grip and the handle.

It is yet another object of the invention to provide an expanded implement handle grip which can be readily and inexpensively manufactured.

In carrying out these and other objects of the invention, there is provided, in one form, an expanded implement handle grip which has an exterior adapted to be gripped by a human hand. The grip further has a hollow interior space with an entrance adapted to receive an implement handle, where the hollow interior space has an interior surface. The interior surface has a plurality of concave features to enhance the ability of the interior surface to grasp the implement handle. The plurality of concave features may be dimples of various shapes and sizes, analogous to those on the outer surface of a golf ball, spiral grooves, or other indentations, depressions, hollows, slits, channels, grooves (straight or otherwise), and the like, to permit the grip have improved gripping ability onto an implement handle.

It will be appreciated that the drawings may not be necessarily to scale, and that certain features may be exaggerated in proportion to other feature for emphasis.

DETAILED DESCRIPTION OF THE INVENTION

Figure 1:
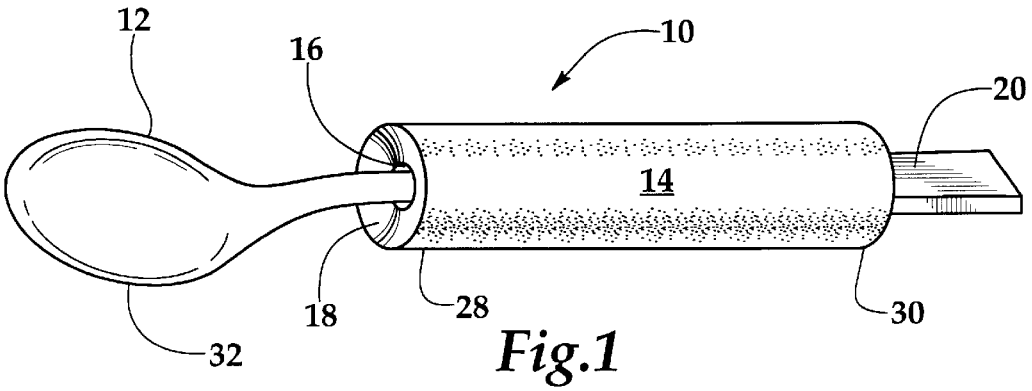
FIG. 1 is a three-quarters, perspective view of one embodiment of the expanded implement handle grip of this invention attached to a spoon.

The invention concerns an expanded implement handle grip having improved and additional advantageous features over such devices previously known. Shown in FIG. 1 is an expanded implement handle grip 10 of this invention encompassing an implement, in this non-limiting case, a spoon 12, where grip 10 has an exterior 14, which is adapted to be gripped by a human hand, which is to simply say it has suitable shape and dimensions in length and circumference to be held by one hand, irrespective of whether it is the right hand or left hand. Indeed, throughout this description, the invention may be used by either the right hand or the left hand. Also visible in FIG. 1 is a small portion of the hollow, interior space 16 which has an entrance 18 adapted to receive an implement handle 20 of spoon 12. Hollow, interior space 16 has an interior surface 22 shown in detail in FIGS. 2 and 3, and surface 22 may possess a plurality of concave features, which may be spiral grooves 24 (FIG. 2) or concave dimples 26 (FIG. 3). It will be appreciated that the plurality of concave features (e.g., 24 or 26) are not limited to the dimples or spiral grooves shown, but may be any concave feature which enhances the ability of the grip 10 to hold an implement handle 20, including, but not necessarily limited to, indentations, depressions, hollows, slits, channels and the like.

Also seen in FIG. 1 is the fact that entrance 18 is concave; the particular embodiment showing an inwardly curved, concave entrance 18, which facilitates the insertion of implement handle 20 into the entrance 18. In a preferred embodiment of the invention, hollow, interior space 16 is centered within grip 10, but the only reasons for this may be aesthetics and/or ease of manufacture. In another preferred embodiment, hollow, interior space 16 may be positioned off-center from the axis (not shown) which runs along the length of and through the center of gravity of grip 10. The advantage to this latter "off-center" embodiment would be that the grip 10 containing implement 12 would have a lower center of gravity in one position, and not be inclined to roll along a slight incline.

It will be appreciated that grip 10 may be symmetrical, that is, exterior 14 may have a first end 28 and a second end 30, where, in one embodiment the first end 28 is proximal to a working portion 32 of the implement 12, where, in this case, the working portion 32 is the bowl of spoon 12. Just as first end 28 is provided with an entrance 18 into hollow, interior space 16, so second end 30 may also be provided with an entrance 18 into hollow, interior space 16, which entrance 18 may be concave.

The length of the expanded implement handle grip 10 is not particularly critical, as long as it is sufficient to permit handling by the user. In FIG. 1, the implement handle 20 is shown to extend from the second end 30 of the grip 10, but the length of grip 10 could be made longer to completely cover implement handle 20, as will be discussed later; please see, for example, FIGS. 5, 6, 7, 11, and 12. Exterior 14 may be contoured or textured to facilitate gripping, and exterior 14 may bear circumferential grooves and/or ridges (not shown) for each of the user's fingers.

Further, expanded implement handle grip 10 is preferably made out of an elastomer material, such rubber, cork, or an elastomeric plastic, such as a polyurethane or a polyurea elastomer, which in turn may or may not be a cellular foam. Such elastomer may or may not have a skin surface different from the interior. For example, some elastomers, such as some polyurethane elastomers, can be designed to have a skin that is somewhat smoother and/or shiny compared with the surface obtained and revealed when the elastomer is cut open to expose the inside. It is, however, preferred in one embodiment that the exterior be textured to enhance the friction and therefor the holding power or grasp of the person using grip 10. Such texturing may take the form of small bumps, grooves, pebbling, ridges, dimples, indentations, knobs, protuberances, and the like. If grip 10 is made of an elastomeric material, rather than a hard or rigid material, it may deform slightly when the user holds or grasps it, thus providing a better hold, since the elastomer pushes back slightly against a person's grip. A particular elastomer that would be suitable for this invention is polyurea or polyurethane foams, such as those used to make the NERF®-brand children's toys.

Figure 2:
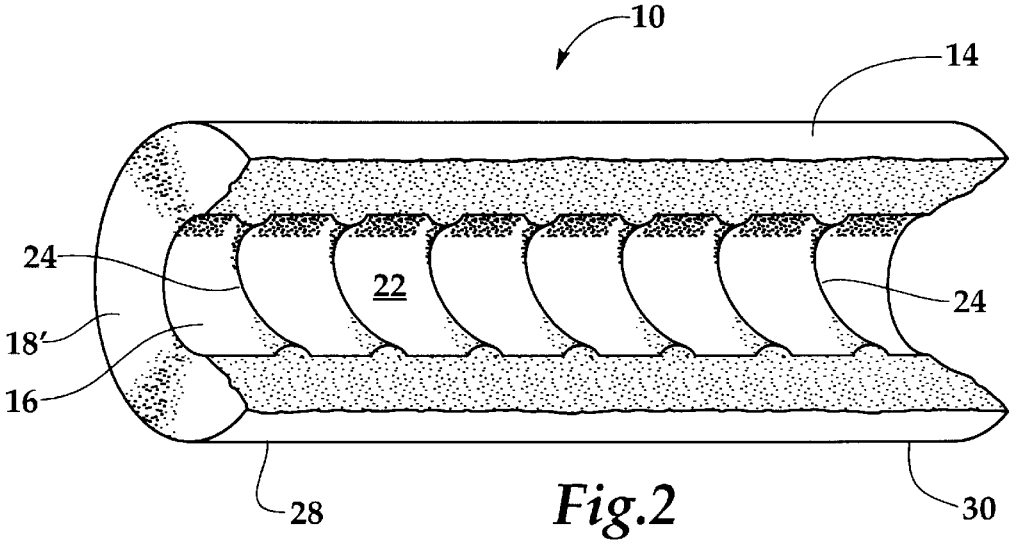
FIG. 2 is a three-quarters, perspective, sectional view of one embodiment of the expanded implement handle grip of this invention showing the hollow interior space having a plurality of concave features in the form spiral grooves.
Figure 3:
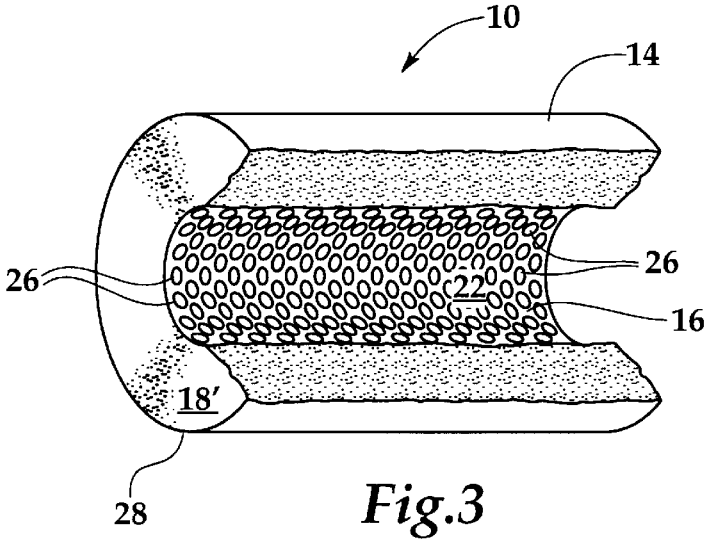
FIG. 3 is a three-quarters, perspective, partial, sectional view of another embodiment of the expanded implement handle grip of this invention showing the hollow interior space having a plurality of concave features in the form of dimples or depressions.

As noted, shown in greater detail in FIG. 2 is an expanded implement handle grip 10 shown in sectional view to reveal hollow, interior space 16 which has an interior surface 22 bearing a plurality of concave features, which in this embodiment are spiral grooves 24. In operation, the user would simply "screw" the grip 10 onto the implement handle 20 with a few twists. The spiral grooves 24, however, would resist the implement handle 20 being pulled straight out (or falling out) of the hollow, interior space 16, although of course, the grip 10 could easily be "unscrewed" from implement handle 20 by twisting in the opposite direction. It will be appreciated that this embodiment of the invention is not particularly limited to right-hand threads or left-hand threads, but could be usefully implemented with either one. It is preferred that the grip 10 be threaded on an implement while turning in a clockwise direction, as is conventional for most spiral grooves.

Also as noted earlier, and shown in greater detail in FIG. 3 is an expanded implement handle grip 10 shown in partial, sectional view to reveal hollow, interior space 16 having an interior surface 22 bearing a plurality of concave features, which in this embodiment are dimples 26, analogous to the dimples on the outside of a conventional golf ball. However, it is anticipated that dimples 26 would be geometrically similar to the dimples on a conventional golf ball, or similarly arranged, since their purpose is to provide texturing to more surely grasp implement handle 20. Further, it may be difficult to implement dimples 26 as small as those in golf balls in some elastomers, such as polyurethane foams. The particular pattern of dimples 26 is not critical, though some sort of pattern is anticipated for ease of manufacture. The dimples also need not be circular in shape, but may have other shapes as long as the desired purpose is achieved.

It will be appreciated, of course that concave features such as spiral grooves 24 and dimples 26, and the like, should not be so effective as to prevent the insertion of implement handle 20 into hollow, interior space 16. They should be sufficiently dimensioned and designed to permit relatively easy insertion of implement handle 20, but then when grip 10 is handled by the user, implement 12 will not fall out of interior space 16. For example, it is expected that, in some embodiments, interior space 16 will deform a bit when the user is holding grip 10, thereby enhancing the ability of the concave features to grasp the implement handle 20.

Figure 5:
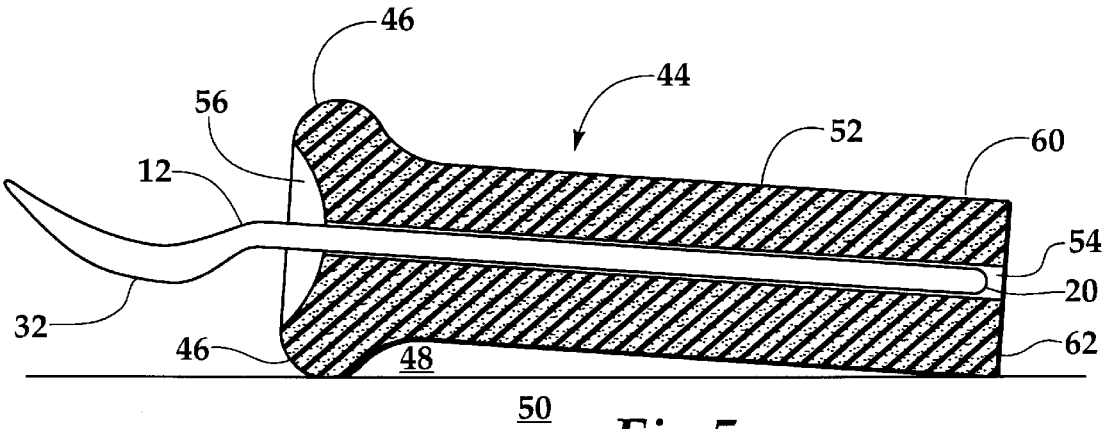
FIG. 5 is a side, sectional, elevation view of another embodiment of the expanded implement handle grip invention containing a spoon, which illustrates having an enlarged first end to create a space between the grip and the flat surface on which it rests.
Figure 13:
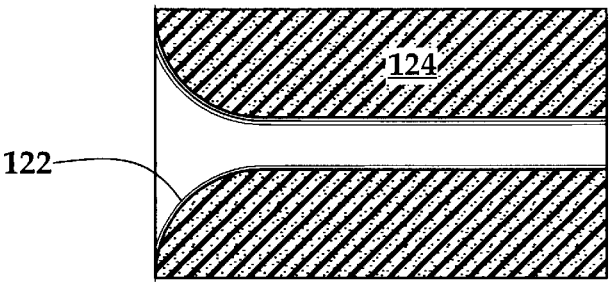
FIG. 13 is a partial, sectional view of an end of another embodiment of the expanded implement handle grip invention.

It should be noted that in FIGS. 2 and 3, entrance 18' is of concave design, but is conical instead of curved. By "conical" is meant having the contour of a straight-walled cone. A conical entrance 82 is shown in both first end 76 and second end 78 in FIG. 6. Note that the sides of conical entrance 82 are straight. This is in contrast to an entrance 56 which is curved inward as shown in FIG. 5 in cross section. It is even possible for the entrance to have walls which curve outwardly, but which still provide an overall concave entrance to make it easier to insert an implement handle into the hollow, interior space; please see FIG. 13 where entrance 122 of enhanced implement handle grip 124 shown in cross-section has outwardly curved sides. In summary, entrance 18' shown in FIGS. 2 and 3 is more like that of entrance 82 shown in FIG. 6, and entrance 18 is curved inwardly, more like entrance 56 shown in the FIG. 5 embodiment.

Figure 4:
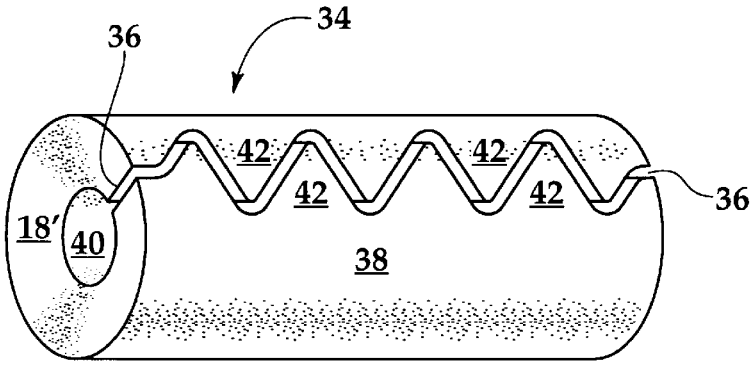
FIG. 4 is a three-quarters, perspective view of yet another embodiment of the expanded implement handle grip invention, showing a slit along the length thereof, which slit has a sinuous path which defines a plurality of interdigitating contours.

Shown in FIG. 4 is another embodiment of the expanded implement handle grip 34 of this invention which has a length and a slit 36 along the length thereof which slit 36 connects the exterior 38 and the hollow, interior space 40 through the thickness of the grip 34 so that the grip 34 may expand in circumference to encompass implement handles of various sizes and designs. Such slits are known in the art, however, but as shown in FIG. 4, the slit 36 has a sinuous path which defines a plurality of interdigitating contours 42 on either side of the slit 36. Although the sinuous path shown in FIG. 4 is regular and the interdigitating contours 42 shown are uniform, this is not a requirement. The interdigitating contours 42 gives the advantage that the exterior 38 more completely wraps around or encompasses the implement handle 20 as the slit 36 expands. This feature permits the user to more surely use the grip 34 as intended.

Figure 11:
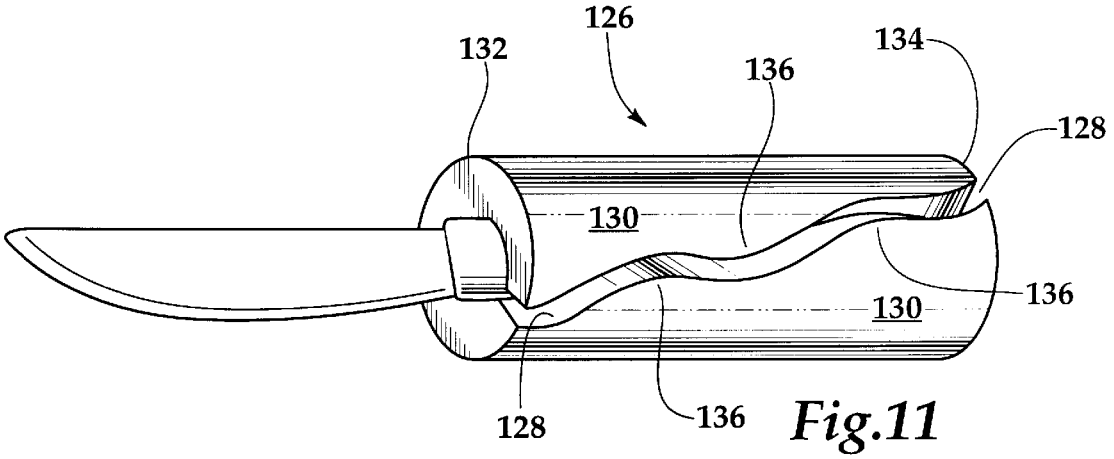
FIG. 11 is a three-quarters, perspective view of another embodiment of the expanded implement handle grip invention, showing a slit along the length thereof, which slit has a sinuous path which defines a plurality of interdigitating contours, and where the slit runs diagonally to the axis of the grip, and along the length thereof.

Shown in FIG. 11 is an alternate embodiment of the expanded implement handle grip 126 modified from the expanded implement handle grip 34 shown in FIG. 4. The grip 126 has a slit 128 which runs the length of the exterior 130 of grip 126 from the first end 132 to the second end 134, but in this case diagonally. That is, slit 128 is tilted with respect to the axis (not shown) of grip 126. Slit 128 divides the exterior 130 into two sides having interdigitating contours 136. It is noted that the sinuous slit 128 depicted in FIG. 11 curves more gently than the slit 36 of the FIG. 4 embodiment.

Figure 7:
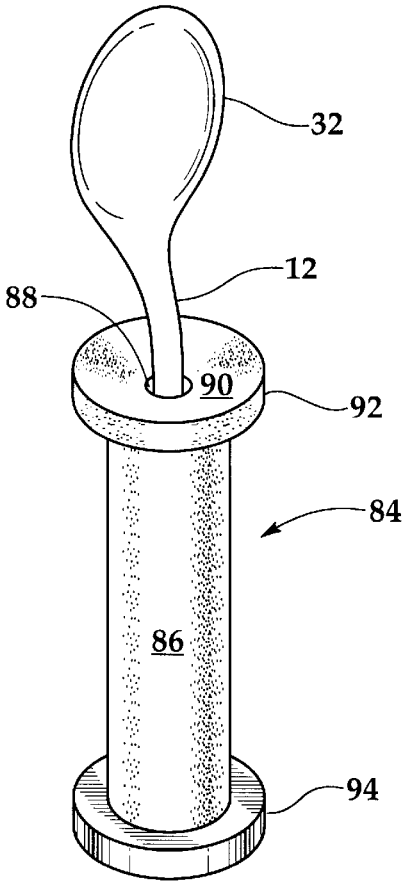
FIG. 7 is a three-quarters, perspective view of another embodiment of the expanded implement handle grip invention, where a weight is present in the second end thereof to permit the grip containing the implement to stand upright.

Shown in FIG. 5 is a side, sectional, elevation view of another embodiment of the expanded implement handle grip invention 44 containing an implement 12 (spoon), which illustrates having an enlarged first end 46 to create a space 48 between the grip 44 and the flat, horizontal surface 50 on which it rests. By one non-limiting definition, first end 46 is sufficiently enlarged if a space 48 is created. Also shown on grip 44 is exterior 52, hollow, interior space 54 which contains implement handle 20 of spoon 12, and curved concave entrance 56. The length of expanded implement handle grip 44 is sufficient to completely encompass the length of implement handle 20. Note also that enlarged first end 46 is proximal to the working portion 32 of spoon 12, and that the second end 60 has a bottom surface 62 to permit the grip 44 containing the implement 12 to more easily stand upright, in a manner such as shown in FIG. 7. In the grip 44 embodiment, the bottom surface 62 is completely flat.

It should be noted that the shape and relative size of enlarged first end 46 is somewhat arbitrary. In FIG. 5, it is depicted as curved, but it could be rectilinear or any suitable shape to create space 48. Further, by another non-limiting definition of "enlarged" it is meant that the exterior 52 has a circumference, and the enlarged end (in this case, first end 46) has a circumference greater than the circumference of exterior 52.

Space 48 permits the grip 44 to be more easily picked up from the horizontal surface 50 by the user. Note also that the working portion 32 (bowl of spoon) of implement 12 is raised from the flat surface 50 to avoid possible contamination of the working portion 32, or vice versa, of the flat surface 50, depending on the nature of the operation in process. In another embodiment of the invention, second end 60 might be enlarged instead of first end 46. While space 48 would still be created, working portion 32 of implement 12 might contact flat surface 50 with this design. It is not necessary that enlarged end 46 be right at the end of grip 44; it is anticipated that enlarged end 46 may be spaced further from concave entrance 56 and still achieve its desired objectives. Again, it would be permissible for grip 44 to be symmetrical, with both first end 46 and second end 60 enlarged, and a curved concave entrance 56 on both ends.

Figure 6:
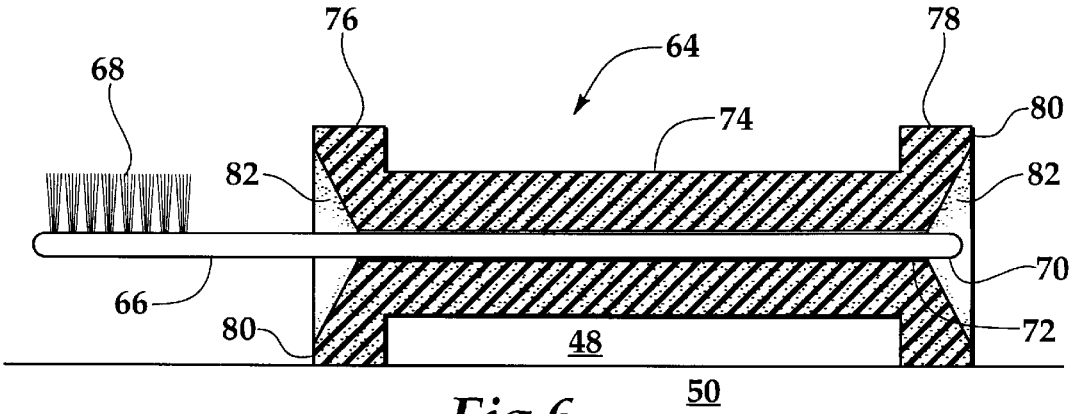
FIG. 6 is a side, sectional, elevation view of still another embodiment of the expanded implement handle grip invention which contains a toothbrush, and illustrates having an enlarged first and second end to create a space between the grip and the flat surface on which it rests.

Indeed, in FIG. 6, a symmetrical expanded implement handle grip 64 is shown in side, sectional, elevation view encompassing an implement 66, which happens to be a toothbrush having a working portion 68 (the brush end) and an implement handle 70 within the hollow, interior space 72 of grip 64. Symmetrical expanded implement handle grip 64 has an exterior 74 with a length, first enlarged end 76, and second enlarged end 78, which are also symmetrical. The first and second enlarged ends 76 and 78 hold the grip 64 off of the flat surface 50 a distance to create space 48 to enable the user to more easily pick up the grip 64 bearing the toothbrush 66. Further, second enlarged end has a bottom surface 80 which permits the grip 64 to hold toothbrush 66 in a vertical, upright position (analogous to the position of expanded implement handle grip 64 of FIG. 7). Bottom surface 80 is flat, but also bears within its purview entrance 82 which is concave, and in this embodiment, straight-walled or conical. Because grip 64 is symmetrical, first enlarged end 76 also has a "bottom" surface 80 which would permit the grip 64 to hold toothbrush 66 in a vertical, upright position if the grip 64 was flipped end over end. First enlarged end 76 also bears concave, conical entrance 82. The apparent benefit of an expanded implement handle grip 64 which is symmetrical is that the user does not have to remember or figure out which end of grip 64 is the "first" end into which implement handle 70 is to be inserted.

Shown in FIG. 7 is a three-quarters, perspective view of yet another embodiment of the expanded implement handle grip 84, which is holding implement 12 (spoon) in an upright position. Some users with limited dexterity or strength may find it more convenient to have the implement 12 in an upright or vertical position when not in use instead of lying flat on a horizontal surface 50. Some users may prefer to have a grip 84 with the ability to hold an implement 12 in either position. Grip 84 has an exterior 86 with a hollow, interior space 88 surrounded by concave entrance 90, which in this embodiment is conical, as well as first enlarged end 92 and second enlarged end 94. In this embodiment, second enlarged end 94 is a weight, that is denser and heavier than the other portions of grip 84. Weighted second end 94 lowers the center of gravity of the combination of grip 84 and implement 12, permitting the combination to more stably stand upright and vertical. Weighted second end 94 may be made of any variety of materials including, but not limited to, metal, wood, plastic, ceramic, etc. as long as it is denser and heavier than the material the balance of grip 84 is manufactured from. Further, it is not necessary that the weight and second end 94 be coextensive. That is, it is possible and permissible within the definition of this invention for the weight to be within the body of grip 84 in some fashion, or even occupying over half of the body of grip 84 to accomplish the described purposes. In other words, the exact design of the weight is rather arbitrary and left to the designer of the particular expanded implement handle grip rather than strictly defined herein.

It has been mentioned before that the various embodiments of the expanded implement handle grip may be symmetrical, and that is certainly true of grip 84. However, if first end 92 is also weighted, the advantage of having second end 94 weighted will not be fully realized.

Figure 8:
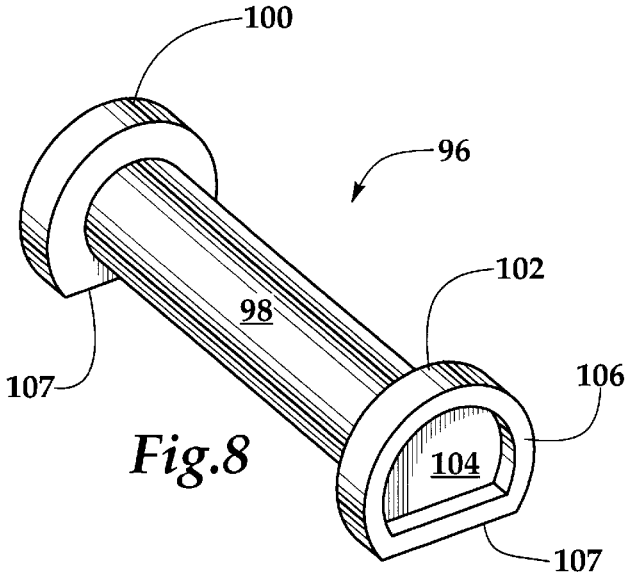
FIG. 8 is a three-quarters, perspective view of another embodiment of the expanded implement handle grip invention, showing how the second end may have a recessed bottom to help keep the grip in an upright position, and a flat side to keep it from rolling across a flat surface.

Shown in FIG. 8 is a three-quarters perspective view of another embodiment of the expanded implement handle grip 96 of this invention having an exterior 98, an enlarged first end 100 and an enlarged second end 102. In this embodiment, grip 96 has a hollow, interior space (not shown) which does not extend all the way through the body of grip 96; note that recessed surface 104 of second end 102 is closed. Enlarged second end 102 has a bottom surface 106 which permits grip 96 to hold an implement in an upright, vertical position (even though grip 96 is not shown in that position in FIG. 8). Recessed surface 104 permits an implement handle to be inserted into hollow, interior space, and recessed surface 104 to even be forced outward slightly by the presence of implement handle, thereby making recessed surface 104 slightly convex. However, because surface 104 is recessed, this slight convexity does not prevent grip 96 from being positioned upright on bottom surface 106. If surface 104 was not recessed, this convex phenomenon would inhibit if not prevent grip 96 from standing upright, when containing an implement. The problem is analogous to a full, aluminum soda can which has been dropped or shaken in such a way that the carbon dioxide has caused the bottom of the can to pop out from a concave shape to a convex orientation so that the can no longer is able to be set stably on a horizontal table.

Also shown in FIG. 8 are flat sides 107 of enlarged first and second ends 100 and 102, which is one embodiment of a roll-inhibiting feature—an optional characteristic of the invention. Such features as flat sides 107 keep the expanded implement handle grip 96 and implement contained therein from rolling off of an inclined surface. It will be appreciated that various other features discussed elsewhere in this description may be added to the embodiment of expanded implement handle grip 96 of FIG. 8, as well as to the other embodiments shown. For example, a weight, such as that described with respect to the expanded implement handle grip 84 of FIG. 7 could be readily provided in enlarged second end 102 of grip 96 or within or on exterior 98 of grip 96 near enlarged second end 102.

Figure 9:
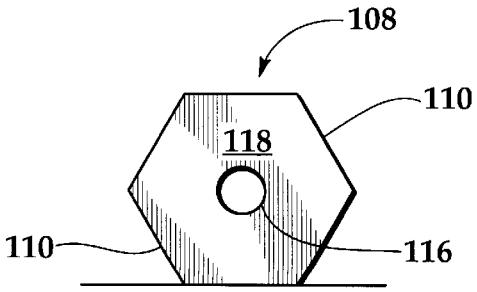
FIGS. 9 and 10 are end views of the bottom of different embodiments of the expanded implement handle grip invention showing that different cross-sections of different designs have different roll-inhibiting features.
Figure 10:
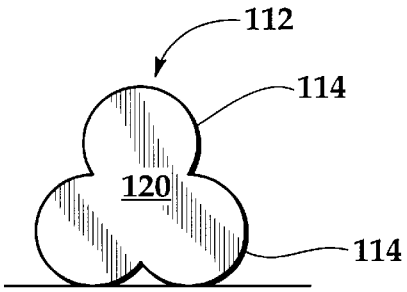

Shown in FIGS. 9 and 10 are end views of the bottom of different embodiments of the expanded implement handle grips invention 108 and 112, respectively showing that different cross-sections of different designs have different roll-inhibiting features 110 and 114, respectively. In FIG. 9, grip 108 has a hollow, interior space 116 which extends through to bottom surface 118. The roll-inhibiting feature 110 is a plurality of flat sides arranged in a regular, hexagonal configuration. These flat sides 110 may be either on the exterior of the grip 108, or an expanded first and/or second end thereof.

Alternatively, in FIG. 10, grip 112 has a bottom surface 120 which is not pierced or penetrated by the hollow, interior space (not shown). In this embodiment, grip 112's roll-inhibiting features are a plurality of nodes or bumps 114. It will be appreciated that there are probably an infinite number of possible roll-inhibiting features that could be devised, and the invention herein is not limited to any particular configuration. Indeed, it is not even necessary that the cross-section of the grip or the enlarged ends having roll-inhibiting features be axially symmetrical, radially symmetrical or symmetrical in any way. In fact, such asymmetry may, in fact, function as a roll-inhibiting feature.

Figure 12:
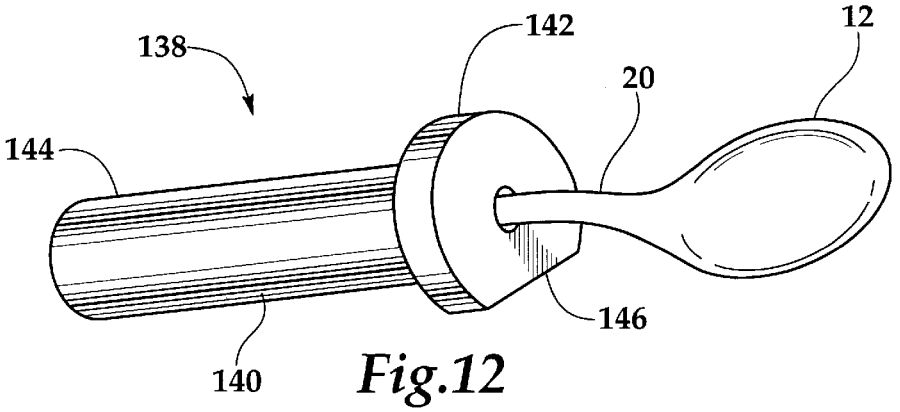
FIG. 12 is a three-quarters, perspective view of an additional embodiment of the expanded implement handle grip invention, where the handle is molded onto an implement handle.

It will be further appreciated that many of the features of the invention discussed herein may be present on an expanded implement handle grip in various combinations and still be within the spirit and scope of the invention. For example, shown in FIG. 12 is another embodiment of the expanded implement handle grip 138 where the grip is permanently molded around the implement handle 20 of spoon 12. While grip 138 does not have a mechanism for removing and replacing implement handle 20 within grip 138, grip 138 does have an exterior 140, a first end 142 where first end 142 is an enlarged end 142, a second end 144, and a roll-inhibiting feature 146, a flat surface, on enlarged end 142. Alternatively, it is anticipated that embodiments of the expanded implement handle grip could be designed which have:

only a sinuous slit in the exterior of the grip;

only a concave or beveled entrance;

only one or two enlarged ends;

only a roll-inhibiting feature;

only a bottom surface for standing the grip upright; or only a weighted bottom for standing the grip upright;

without the additional presence of other features, for example, the concave features on the interior surface. It will be appreciated that a number of combinations of the various features disclosed herein may be imagined which are not explicitly depicted in the Figures or described in the specification. For example, an expanded implement handle grip may be imagined which is permanently molded or otherwise affixed onto an implement handle, which grip contains a weighted bottom and a roll-inhibiting feature, and none of the other disclosed or illustrated features.

Many modifications may be made in the expanded implement handle grip of this invention without departing from the spirit and scope thereof which are defined only by the appended claims. For example, it may be discovered that a particular pattern of dimples on the interior surface, or a particular size and shape of spiral grooves may be particularly advantageous. Alternatively, the exterior may be found to have a particular shape or dimension that is preferred over other shapes. All of these possibilities, and others, would be within the scope of the invention.

I claim:

1. An expanded implement handle grip comprising:

an exterior adapted to be gripped by a human hand;

a hollow interior space within the grip, the hollow interior space having an entrance adapted to receive an implement handle, the hollow interior space having an interior surface; and a plurality of concave dimples within the interior surface to enhance the ability of the interior surface to grasp the implement handle.

2. The expanded implement handle grip of claim 1 where the expanded implement grip has a first end, a second end, a length, and a slit along the length thereof from the first end to the second end, which slit connects the exterior and the hollow interior surface such that the grip may expand in circumference to encompass an implement handle, where the slit has a sinuous path defining a plurality of interdigitating contours on either side of the slit.

3. The expanded implement handle grip of claim 2 where the expanded implement handle grip has an axis, and the slit is oriented diagonally to the axis.

4. The expanded implement handle grip of claim 1 where the entrance is concave to receive an implement handle.

5. The expanded implement handle grip of claim 1 where the exterior has a first end and a second end, where at least one of either the first end and second end is enlarged to create a space under the expanded implement handle grip and a flat surface when the expanded implement handle grip rests on the surface.

6. The expanded implement handle grip of claim 5 where both the first end and the second end are enlarged.

7. The expanded implement handle grip of claim 1 further comprising at least one roll-inhibiting feature adapted to keep the expanded implement handle grip from rolling on a flat surface.

8. The expanded implement handle grip of claim 7 where the roll-inhibiting feature is a flat side.

9. The expanded implement handle grip of claim 1 where the expanded implement handle grip is made of an elastomeric material.

10. The expanded implement handle grip of claim 1 where the exterior has a first end and a second end, where the first end is proximal to a working portion of the implement, and where the second end contains a weight that is denser and heavier than the other portions of the grip that permits the grip containing the implement to stand upright.

11. The expanded implement handle grip of claim 1 where the exterior has a first end and a second end, where the first end is proximal to a working portion of the implement, and where the second end has a bottom surface that permits the grip containing the implement to stand upright.

12. An expanded implement handle grip comprising:

a first end, a second end, a length, an exterior adapted to be gripped by a human hand;

a hollow interior space within the grip, the hollow interior space having a concave entrance adapted to receive an implement handle, the hollow interior space having an interior surface;

a plurality of concave dimples within the interior surface to enhance the ability of the interior surface to grasp the implement handle; and a slit along the length thereof from the first end to the second end, which slit connects the exterior and the hollow interior surface such that the grip may expand in circumference to encompass an implement handle, where the slit has a sinuous path defining a plurality of interdigitating contours on either side of the slit.

13. The expanded implement handle grip of claim 12 where the exterior has a first end and a second end, where at least one of either the first end and second end is enlarged to create a space under the expanded implement handle grip and a flat surface when the expanded implement handle grip rests on the surface.

14. The expanded implement handle grip of claim 12 further comprising at least one roll-inhibiting feature adapted to keep the expanded implement handle grip from rolling on the flat surface.

15. The expanded implement handle grip of claim 12 where the exterior has a first end and a second end, where the first end is proximal to a working portion of the implement, and where the second end contains a weight that permits the grip containing the implement to stand upright.

16. The expanded implement handle grip of claim 12 where the exterior has a first end and a second end, where the first end is proximal to a working portion of the implement, and where the second end has a bottom surface that permits the grip containing the implement to stand upright.

17. An expanded implement handle grip comprising:

an exterior adapted to be gripped by a human hand;

a hollow interior space within the grip, the hollow interior space having an entrance adapted to receive an implement handle, the hollow interior space having an interior surface; and a plurality of spiral grooves within the interior surface to enhance the ability of the interior surface to grasp the implement handle and to facilitate insertion of the implement handle into the hollow interior space.

18. The expanded implement handle grip of claim 17 further comprising at least one roll-inhibiting feature adapted to keep the expanded implement handle grip from rolling.

19. The expanded implement handle grip of claim 18 where the roll-inhibiting feature is a flat side.

20. The expanded implement handle grip of claim 18 where the entrance is concave to receive an implement handle and facilitate its insertion.

21. The expanded implement handle grip of claim 17 where at least one of a first end and a second end of said grip is enlarged to create a space under the expanded implement handle grip and a flat surface when the expanded implement handle grip rests on the flat surface.

* * * * *